United States Patent [19]

Michael

[11] 4,307,700

[45] Dec. 29, 1981

[54] DEVICE FOR AUTOMATICALLY CHARGING A WOODBURNING STOVE

[76] Inventor: John A. Michael, Rte. 2, Box 27, Pisgah Forest, N.C. 28768

[21] Appl. No.: 110,182

[22] Filed: Jan. 7, 1980

[51] Int. Cl.[3] ..... F24B 7/00; F23N 13/00; F23K 3/00

[52] U.S. Cl. ..... 126/68; 110/293; 110/101 C

[58] Field of Search ..... 110/101 C, 101 CF, 101 CC, 110/293; 126/68, 65, 67, 87

[56] References Cited

U.S. PATENT DOCUMENTS

| | | | |
|---|---|---|---|
| 133,937 | 12/1872 | Hatch | 110/293 |
| 2,483,847 | 10/1949 | Sagar | 110/101 C |
| 4,185,567 | 1/1980 | Grossniklaus | 110/293 |
| 4,201,186 | 5/1980 | Paquin | 126/83 |

*Primary Examiner*—Samuel Scott
*Assistant Examiner*—Wesley S. Ratliff, Jr.
*Attorney, Agent, or Firm*—Bailey, Dority & Flint

[57] ABSTRACT

A device for automatically dropping logs at a predetermined time for charging a fire laid on the bottom of a woodburning stove. The device includes a pair of elongated arcuate shaped log supporting members each of which is journaled within the stove adjacent a respective top side corner thereof. A latching system is connected to the log supporting member for releasably maintaining the log supporting members in a substantially horizontal supporting position. An electrically operated movable member is connected to the latching system for releasing the latching system upon being energized under control of a timing device at a predetermined time. As a result, the stove can be automatically charged during the middle of the night ensuring a fire in the morning.

7 Claims, 4 Drawing Figures

DEVICE FOR AUTOMATICALLY CHARGING A WOODBURNING STOVE

BACKGROUND OF THE INVENTION

Woodburning stoves normally have to be charged every several hours in order to keep the fire from going out. This is a particular problem at night, and in order to keep a fire burning all night long, it is necessary to get up in the middle of the night and place logs on the fire so as to ensure a fire upon awaking in the morning.

Another problem in charging stoves, particularly with green wood is that the wood is slow burning and initially hard to start.

In an attempt to produce automatic fire kindlers, several devices have been proposed such as the device shown in U.S. Pat. No. 615,216 wherein kindling is stored outside of a fireplace and upon being activated is rotated on a frame over the fire located in the fireplace for being deposited therein. One problem with such a device is that it is quite complicated and unsightly and also bark and the like will drop off the logs around the surrounding fireplace.

A similar device is shown in U.S. Pat. No. 625,243.

In U.S. Pat. No. 2,122,314, there is disclosed a fuel supply means for brooder stoves wherein coal and the like is carried adjacent the top of the stove and by tripping a latching mechanism, the coal is deposited in the furnace. It is noted that the coal is positioned directly over the fire and as a result it is possible if the coal is not isolated from the fire to have premature combustion.

Other automatically charging furnaces are disclosed in U.S. Pat. Nos. 1,862,477 and 3,888,231.

SUMMARY OF THE INVENTION

In accordance with the present invention, a pair of elongated arcuate shaped log supporting members are journaled within the stove adjacent the top side corners of the woodburning stove. As a result, green logs can be positioned on the log supporting members and/or preheated and dried for several hours to enhance the kindling thereof. Elongated lever arms are connected to the log supporting members and extend downwardly through a housing for being latched in a first position wherein the log supporting members assume a substantially horizontal position for supporting the log. Each of the lever arms has a notched out portion which, when brought against the edge of a hole provided in the top of a housing, hold the log supporting members in a substantially horizontal position. The lever arms are released from their latched position by operation of an electrically operated movable member such as a solenoid or relay. At a predetermined time, the relay is energized causing a spring-loaded latching system to be disengaged. Upon disengagement of the spring-loaded latching mechanism, a pivot arm is shifted which, in turn, pulls the vertically extending lever arms from their latched position allowing the lever arms to pull up through the hole in the top cover by means of the weight of the log supporting member dropping the logs into the fire.

Accordingly, it is an important object of the present invention to provide a simple and reliable device for charging a fire with logs at a predetermined time.

Another important object of the present invention is to provide a device wherein green logs can be supported within a woodburning stove for drying and preheating prior to being automatically dropped onto a fire for kindling.

Still another important object of the present invention is to provide a simple and effective mechanism for automatically charging a fire within a woodburning stove with logs.

These and other objects and advantages of the invention will become apparent upon reference to the following specification, attendant claims and drawings.

DESCRIPTION OF A PREFERRED EMBODIMENT

Figure 1:
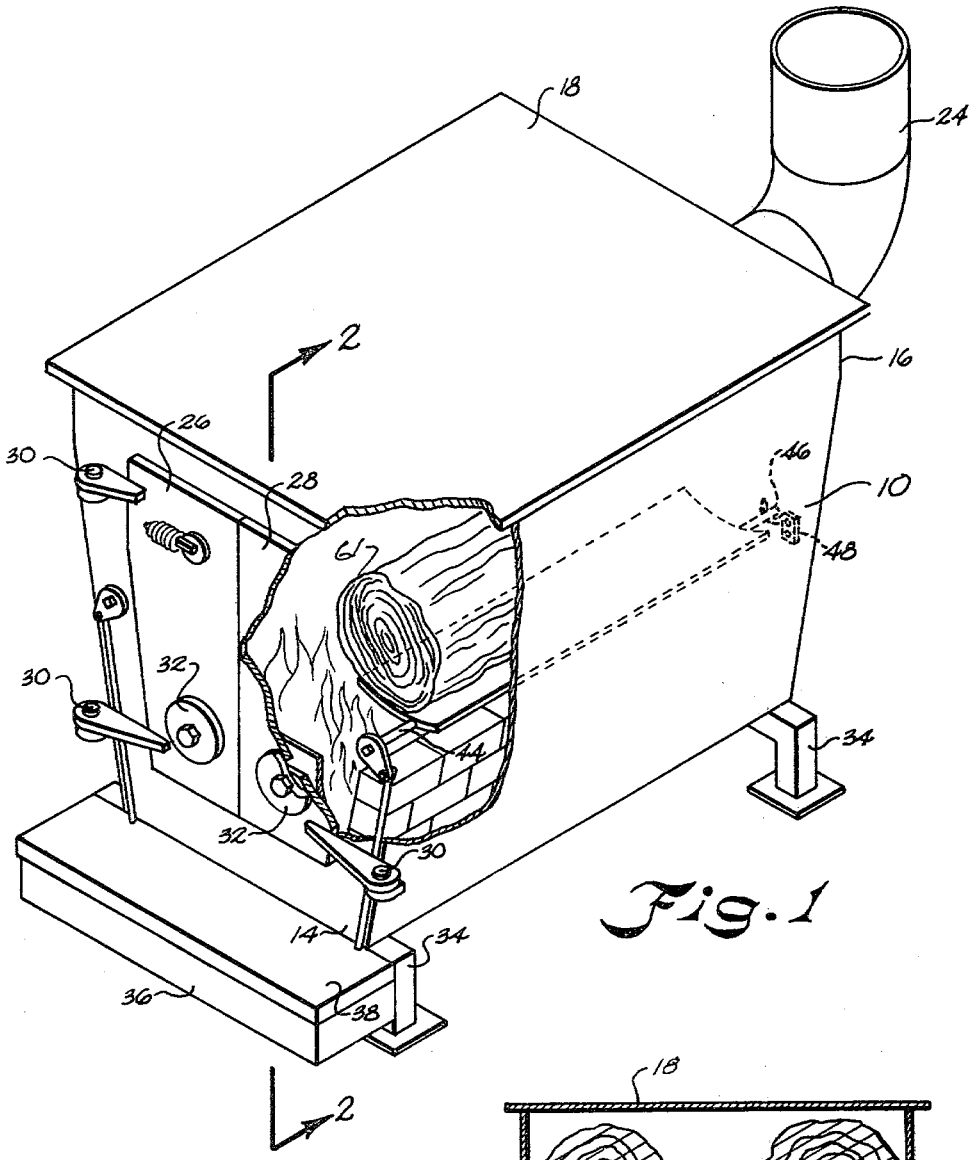
FIG. 1 is a perspective view with parts broken away illustrating a log being supported within a woodburning stove prior to dropping.

Referring to FIG. 1, there is illustrated a woodburning stove including side walls 10 and 12, front wall 14 and rear wall 16 that are joined by a top 18 and bottom 20. Extending out of the rear wall 16 is a conventional exhaust pipe 24. A pair of hinged doors 26 and 28 are carried in the front wall and are supported on hinges 30. Adjustable air vents 32 are provided in the front doors 26 and 28. The woodburning stove may be supported on any suitable legs 34.

Positioned adjacent the front bottom portion of the stove is an elongated rectangular shaped box 36 that has a top 38 provided thereon and a hinged or removable front cover 39.

The device for automatically dropping the logs at a predetermined time includes a pair of arcuate shaped log supporting members 40 and 42 which are pivotably supported by means of rod-like members 44 and 46 carried on opposite ends thereof. The rod-like member 46 is supported on a U-shaped bracket 48 that is, in turn, secured by any suitable means to the side wall of the stove. The rod-like member 44 extends through a hole provided in the front wall 14 of the stove which is of a diameter slightly larger than the rod-like member 44 for allowing the rod-like member to rotate therein. The rod-like member 44 terminates in a substantially square shaped end such as shown at 47 which extends through a linkage arm 50 that fits snugly on the end thereof. The square shaped end 47 extends through the linkage 50 for accommodating a handle shown on the right in FIG. 3 that can be slipped over for resetting the log supporting members.

Pivotably attached to and extending down from each of the linkages 50 is an elongated lever arm 52 which extends through a hole 54 provided in the top 38 and terminates within the box. A latching means generally designated by the reference character 56 is releasably connected to the elongated lever 52 for holding the lever in a latched log supporting position when in a first position and when in a second position allowing the lever to assume an unlatched position wherein the log supporting member is pivoted to a log dropping position.

The latching means includes a wedge-shaped notch 58 that is provided in the lever arm that engages the top 38 of the box 36 when the lever arm 52 is pushed outwardly from the center of the stove. As a result of the weight of a log 61 resting on a log supporting member 40 or 42, the bottom of the notch 58 is pulled flush against the bottom surface of the top 38 and is held in a latched position until the bottom ends of the lever 52 are pulled towards the center of the stove by means of the linkage arms 60 and 62 and a pivot arm 64.

Figure 3:
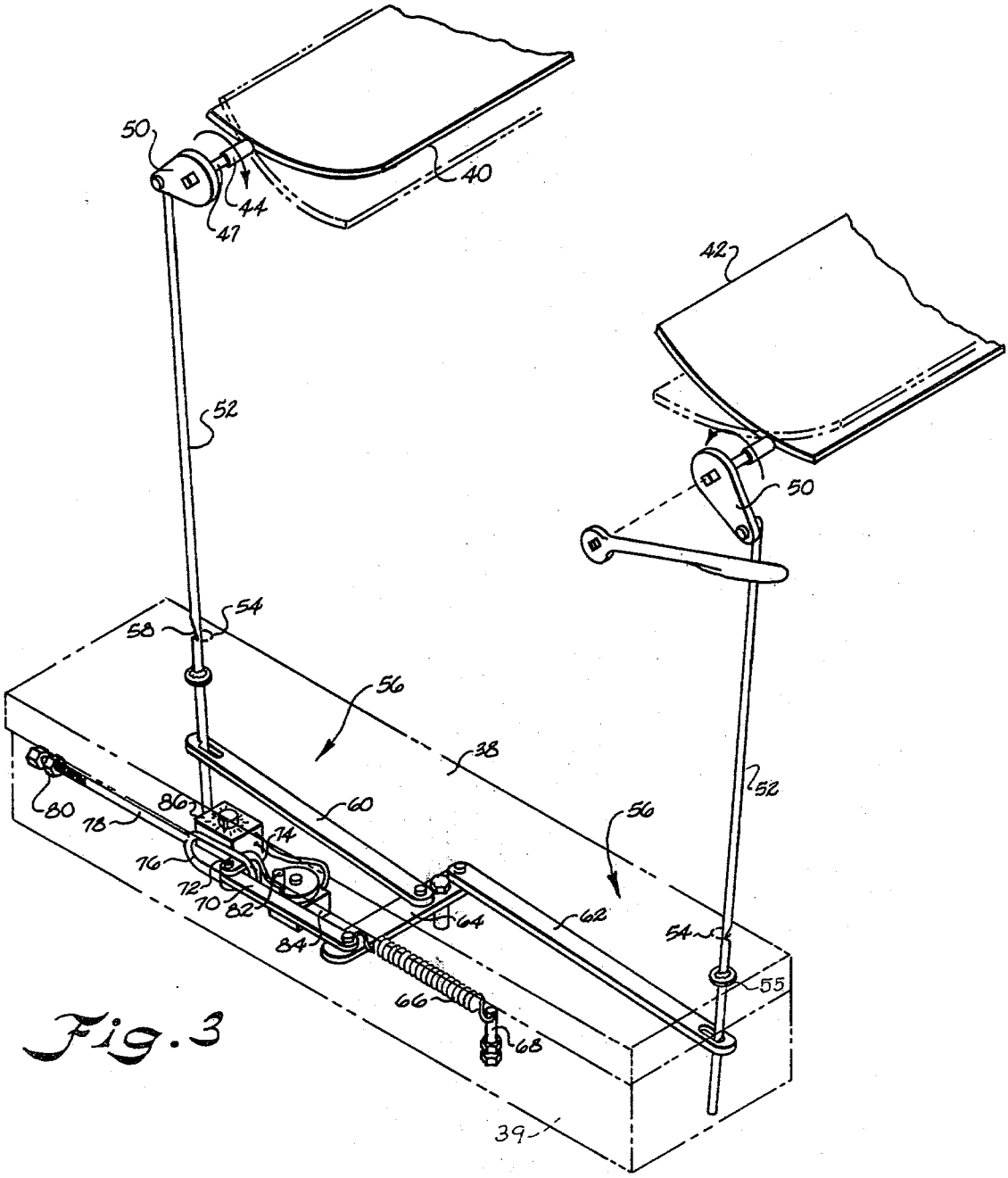
FIG. 3 is an enlarged perspective view illustrating a device for supporting logs within a woodburning stove and a latching mechanism therefor.
Figure 4:
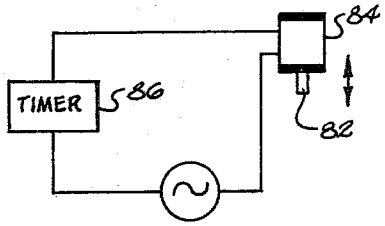
FIG. 4 is a schematic diagram illustrating the timer mechanism for triggering the dropping of the logs.

The means for causing the latching means 56 to be moved also includes a spring 66 which has one end anchored to a bolt 68 secured to the bottom of the box and the other end fixed adjacent the outer end of the pivotal lever 64. Also attached by means of a pin to the pivotal lever 64 is a latch member that includes a horizontal extending arm 70 that is connected by means of a pivot 72 to a latch 74. Extending between the latch 74 and the arm 70 is an elongated ring-shaped member 76 that is, in turn, connected by means of a rod 78 and nuts 80 to the side of the box 36. As long as the latch 74 is pressed or held in the position such as shown in FIG. 3, the pivot arm 64 is held in a fixed position such as shown. The latch 74 is held in this position by means of a movable plunger 82 forming part of a relay 84. As long as the plunger 82 is extended adjacent the side of the latch 74, the latch is held in the latched position as shown in FIG. 3. However, when the relay 84 is energized by means of a timing clock 86 and a source of electricity, a plunger 82 is retracted allowing the latch 74 to flip out counterclockwise under the force of the spring 66 causing pivotal arm 64 to pivot counterclockwise. When the pivot arm 64 pivots counterclockwise, the linkages 60 and 62 pull the elongated levers 52 towards the center of the stove releasing the latching means allowing the log supporting members 40 and 42 to pivot downwardly for dropping any logs provided thereon onto the fire.

Figure 2:
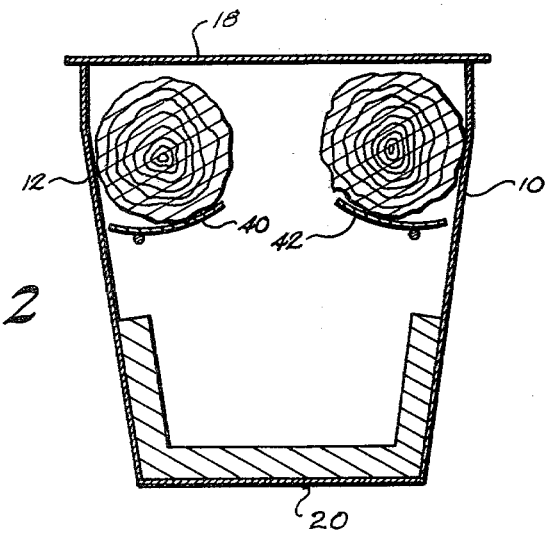
FIG. 2 is a sectional view taken along line 2—2 of FIG. 1.

As can be seen in FIG. 2, when the logs are supported on the log supporting members 40 and 42, they are supported adjacent the top side corners. As a result, a green log can be positioned on the arcuate shaped log supporting members and be dried and preheated prior to being deposited on the fire. Of course, dry logs can also be used. Not only does the device constructed in accordance with the present invention provide a means for automatically depositing logs on a fire at a predetermined time, it also enhances the burning logs by providing a means for preheating and drying green logs so they can be readily used in the stove. The side walls 10 and 12 slope inwardly towards the fire so as to guide the logs as they are dropped onto the fire bed.

It is to be understood that other means such as thermostats could be used for unlatching latch 74.

A washer 55 is welded to the lever 52 for limiting the upward movement thereof.

While a preferred embodiment of the invention has been described using specific terms, such description is for illustrative purposes only, and it is to be understood that changes and variations may be made without departing from the spirit or scope of the following claims.

What is claimed is:

1. In a wood burning stove having front, rear and side walls joined by a top and bottom a device for automatically drying and dropping a log at a predetermined time for charging a fire carried on said bottom comprising:

an elongated arcuate shaped log supporting member journaled within said stove adjacent the juncture of said top and side wall displaced from the center of said stove where a fire is normally located, said log supporting members being disposed to support a log completely within the interior of said stove so that said log may be dried prior to burning;

said log supporting member being rotatably journaled in said stove having a first position for supporting said log and a second position in which said supporting member pivots downwardly and drops said log into said fire;

an elongated lever arm connected to said log supporting member;

a latching means operably connected to said lever for holding said lever in a latched position wherein said log supporting member is held in a log supporting position in said first position and when in said second position said latching means allows said lever to assume an unlatched position wherein said log supporting member is pivoted to the log dropping position, and means for causing said latching means to be moved from said first position to said second position at a predetermined time for dropping a log carried on said log supporting member into said fire.

2. The device as set forth in claim 1 further comprising:

rod-like members extending from opposed ends of said log supporting member;

support members engaging said rod-like members permitting said log supporting member to pivot when released by said latching means.

3. The device as set forth in claim 1 further comprising:

said means for causing said latching means to be moved from said first position to said second position including, a spring-loaded pivot arm;

a latch member holding said spring loaded pivot arm in a first position when engaged;

an electrically operated movable member operably connected to said latch member for disengaging said latch member when energized, and means for selectively energizing said electrically operated movable member causing said latching means to be moved from said first position to said second position for dropping a log carried on said log supporting member.

4. The device as set forth in claim 3 further comprising:

said means for selectively energizing said electrically operated movable member includes:

(i) a source of electrical power;

(ii) a relay having a movable plunger, and (iii) a timer connected between said solenoid and said source of electrical power providing electrical connection therebetween at a predetermined time.

5. The device as set forth in claim 2 further comprising:

a handle carried on the end of one of said rod-like members for pivoting said rod-like member and said log supporting member back to said log supporting position for being loaded with a log and for setting said latching means in said latched position.

6. In a wood burning stove having front, rear and side walls joined by a top and bottom, a device for drying logs and automatically dropping logs at a predetermined time for charging a fire laid on said bottom comprising:

a pair of elongated arcuate shaped log supporting members each journaled within said stove adjacent a respective juncture of said top and a respective side wall displaced from the center of said stove where a fire is normally located, said log supporting members being disposed to support a log completely within the interior of said stove so that said log may be dried prior to burning;

said log supporting members having a first log supporting position and a second log releasing position;

a latching system connected to said log supporting members for releasably maintaining said log supporting members in said first log supporting position;

electrically operated movably member operably connected to said latching system for releasing said latching system when energized for moving said log supporting members to said second log releasing position dropping said logs carried thereon, and means for selectively energizing said electrically operated movable member for releasing said latching system and dropping said logs.

7. The wood burning stove as set forth in claim 6 further comprising:

said side walls of said stove sloping inwardly towards said fire for guiding said logs to said fire as they are dropped.

* * * * *